US006458173B1

(12) United States Patent
Lin

(10) Patent No.: US 6,458,173 B1
(45) Date of Patent: Oct. 1, 2002

(54) FUEL ADDITIVE AND FUEL COMPOSITION CONTAINING THE SAME

(75) Inventor: Jian Lin, Reading (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/453,286

(22) Filed: Aug. 18, 2000

(51) Int. Cl.[7] ..... C10L 1/18; C10L 1/22
(52) U.S. Cl. ..... 44/389; 44/391
(58) Field of Search ..... 44/385, 386, 388, 44/389, 391

(56) References Cited

U.S. PATENT DOCUMENTS

| | | | | | |
|---|---|---|---|---|---|
| 3,950,258 | A | * | 4/1976 | Imai et al. | |
| 4,057,436 | A | * | 11/1977 | Davies | 106/288 Q |
| 4,079,015 | A | * | 3/1978 | Paucot et al. | |
| 4,349,389 | A | * | 9/1982 | Schofield | 106/308 |
| 5,000,792 | A | | 3/1991 | Ohta et al. | |
| 5,082,924 | A | * | 1/1992 | Speranza | 528/339 |
| 5,391,826 | A | * | 2/1995 | Speranza | 564/138 |
| 5,431,726 | A | * | 7/1995 | Rolan | 106/266 |
| 5,536,445 | A | * | 7/1996 | Campbell et al. | 252/308 |
| 5,540,767 | A | * | 7/1996 | Rolan | 106/287.35 |
| 5,547,804 | A | * | 8/1996 | Nishizawa et al. | 106/20 B |
| 5,622,532 | A | * | 4/1997 | Cherpeck | 44/389 |
| 5,721,201 | A | * | 2/1998 | Tomassen et al. | 508/469 |
| 5,925,152 | A | * | 7/1999 | Barratt et al. | 44/350 |
| 6,188,828 | B1 | * | 2/2001 | Mencke | 385/141 |

FOREIGN PATENT DOCUMENTS

| | | | | |
|---|---|---|---|---|
| EP | 0164817 | * | 12/1985 | B01F/17/00 |
| EP | 207 560 A1 | | 1/1987 | |
| EP | 491 439 A1 | | 6/1992 | |
| EP | 588 426 A1 | | 3/1994 | |
| EP | 798 364 A1 | | 10/1997 | |
| GB | 1373660 | * | 6/1972 | C08G/17/02 |
| GB | 1342746 | * | 11/1974 | C08G/39/00 |
| GB | 2001083 A | * | 1/1979 | C08G/73/04 |
| WO | WO 87/01126 | | 2/1987 | |
| WO | WO 95/17473 | | 6/1995 | |
| WO | WO96/07689 | * | 3/1996 | C08G/63/664 |
| WO | WO 97/41092 | | 11/1997 | |

* cited by examiner

*Primary Examiner*—Margaret Medley

(57) ABSTRACT

The invention provides the use of a poly(hydroxy-carboxylic acid)amide or -ester derivative of general formula I:

(I)

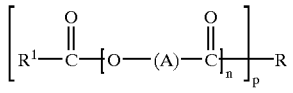

wherein R is the residue of an amine, an aminoalcohol or a polyol linked to the or each poly(hydroxycarboxylic acid) via an amide or ester linkage; $R^1$ is hydrogen or optionally substituted hydrocarbyl group containing up to 50 carbon atoms; A is an optionally substituted hydrocarbyl group; n is from 1–100, preferably 1–10 and p is from 1–5, as a fuel additive acting as a detergent and as a lubricity additive in fuel compositions.

Moreover, the invention provides a fuel oil composition comprising of a major amount of a fuel oil, and a minor amount of an the additive as well as a additive concentration for use in a fuel oil composition.

5 Claims, No Drawings

FUEL ADDITIVE AND FUEL COMPOSITION CONTAINING THE SAME

FIELD OF THE INVENTION

The invention relates to a fuel additive and fuel composition containing the same. More in particular, the invention relates to a fuel additive acting as a detergent and as a lubricity additive in fuel compositions, in particular in low-sulphur fuel compositions, more in particular in low-sulphur diesel fuel compositions.

BACKGROUND OF THE INVENTION

From EP-A-0,798,364 fuel additives are known, based on either the salt of a carboxylic acid and an aliphatic amine, or an amide obtained by dehydration-condensation between a carboxylic acid and an aliphatic amine. The additive can be incorporated into a fuel, i.e., a diesel fuel, and thus reduce the amount of deposit in the injection nozzle of a compression-ignition diesel engine, improve lubricity of the diesel fuel, and reduce wear of the fuel injection pump of the engine. In short, the additive acts as a detergent and as a lubricity additive. Fuel additives acting both as detergent and as lubricity additive are rare. It would therefore be desirable to extend the range of such additives, or better still, to provide improved additives acting both as detergent and lubricity additive.

SUMMARY OF THE INVENTION

Accordingly, the invention provides the use of a poly (hydroxycarboxylic acid)amide or -ester derivative of general formula I:

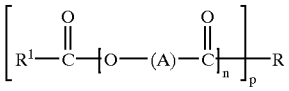

(I)

wherein R is the residue of an amine, an aminoalcohol or a polyol linked to the or each poly(hydroxycarboxylic acid) via an amide or ester linkage; $R^1$ is hydrogen or optionally substituted hydrocarbyl group containing up to 50 carbon atoms; A is an optionally substituted hydrocarbyl group; n is from 1–100, preferably 1–10 and p is from 1–5, as a fuel additive acting as a detergent and as a lubricity additive in fuel compositions.

Moreover, the invention provides a fuel oil composition comprising of a major amount of a fuel oil, and a minor amount of an the additive as well as a additive concentration for use in a fuel oil composition.

DETAILED DESCRIPTION OF THE INVENTION

As used herein, the term "hydrocarbyl" represents a radical formed by removal of one or more hydrogen atoms from a carbon atom of a hydrocarbon (not necessarily the same carbon atoms in case more hydrogen atoms are removed). In case of $R^1$ useful hydrocarbyls are aromatic, aliphatic, acyclic or cyclic. Preferably, the hydrocarbyls are aryl, cycloalkyl, alkyl or alkenyl, in which case they may be straight-chain or branched-chain. Representative hydrocarbyls include phenyl, naphthyl, methyl, ethyl, butyl, pentyl, methylpentyl, hexenyl, dimethylhexyl, octenyl, cyclooctenyl, methylcyclooctenyl, dimethylcyclooctyl, ethylhexyl, octyl, isooctyl, dodecyl, hexadecenyl, eicosyl, hexacosyl, triacontyl and phenylethyl. The optionally substituted $R^1$ is preferably aryl, alkyl or alkenyl containing up to 50 carbon atoms, especially from 7 to 25 carbon atoms such as heptyl, octyl, undecyl, lauryl, heptadecyl, heptadenyl, heptadecadienyl, stearyl, oleyl, or linoleyl. Other examples of $R^1$ include $C_{4-8}$ cycloalkyl such as cyclohexyl; polycycloalkyls such as polycyclic terpenyl groups which are derived from naturally occurring acids such as abietic acid; aryl such as phenyl; aralkyl such as benzyl; polyaryl such as naphthyl, biphenyl, stibenyl and phenylmethylphenyl.

When the hydrocarbyl is substituted, it may contain a functional group such as carbonyl, carboxyl, nitro, hydroxy, halo, alkoxy, tertiary amino (no N—H linkages), oxy, cyano, sulfonyl and sulfoxyl. The majority of the atoms, other than hydrogen, in substituted hydrocarbyls are carbon, with the heteroatoms (e.g., oxygen, nitrogen and sulphur) representing only a minority, about 33% or less, of the total non-hydrogen atoms present.

Those skilled in the art will appreciate that functional groups such as hydroxy, halo, alkoxy, nitro and cyano in a substituted hydrocarbyl group will displace one of the hydrogen atoms of the hydrocarbyl, whilst functional groups such as carbonyl, carboxyl, tertiary amino (—N—), oxy, sulfonyl and sulfoxyl in a substituted hydrocarbyl group will displace a —CH— or —$CH_2$— moiety of the hydrocarbyl.

In "optionally substituted hydrocarbyl of 1 to 50 carbon atoms", the expression "1 to 50 carbon atoms" represents the total number of carbon atoms in the optionally substituted hydrocarbyl group. The same applies to "optionally substituted hydrocarbyl" of lower numbers of specified carbon atoms.

The or each radical $R^1$ is preferably unsubstituted or subtituted by a group selected from hydroxy, halo or alkoxy group, especially $C_{1-4}$ alkoxy. Preferred $R^1$ are residues of a stearyl, oleyl, 12-hydroxystearyl, 12-hydroxyoleyl, and that derived from naturally occurring oil such as tall oil fatty acid.

The moiety represented by A may be an aromatic, aliphatic or cycloaliphatic group. It is preferably an arylene, alkylene or alkenylene group, especially one containing from 4 to 25 carbon atoms with at least 4 carbon atoms between the oxygen atom and carbonyl group. More preferably it is a saturated alkylene group or an arylene group. When n is greater than 1, this moiety may be the same or different. This moiety may carry other substituents which do not confer water solubility on the molecule, such as halogen and $C_{1-4}$ alkoxy. Preferred examples of O—A—CO— are 12-oxystearyl, 12-oxyoleyl and 6-oxycaproyl. More preferred examples are saturated groups such as 12-oxystearyl, 6-oxycaproyl.

The amines, aminoalcohols or polyols which react with poly(hydroxycarboxylic acid) to form products of formula I are as defined in WO97/41092. For example, various amines and their preparations are described in U.S. Pat. Nos. 3,275,554, 3,438,757, 3,454,555, 3,565,804, 3,755,433 and 3,822,209. Complex amines such as "Starburst" (Trade Mark) dendrimers may be used, e.g. the compound of formula $[CH_2N((CH_2)_2CONH\ (CH_2)_2NH_2)_2]_2$.

Examples of polyols include ethylene glycol, glycerol, trimethylolethane, trimethylolpropane, 1,2-butanediol, 2,3-hexanediol, 2,4-hexanediol, pinacol, erythritol, arabitol, sorbitol, mannitol, pentaerythritol, dipentaerythritol and tripentaerythritol. Preferred derivatives of formula I are those wherein the compound of R(H)p, of which R represents the residue, has the general formula II:

$$HX[(CR^2R^2)_aO]_b[(CR^3R^3)_cNR^4]_z[R^9)_s(CHR^3)_eR^5]_f[(CR^3R^3)_g(R^6)_h]_iR^7 \quad (II)$$

wherein X is O or $NR^4$; each $R^2$ independently represents hydrogen, hydrocarbyl of 1 to 10 carbon atoms or hydrocarbyl of 1 to 10 carbon atoms substituted by at least one hydroxy group; each $R^3$independently represents hydrogen or hydrocarbyl of 1 to 10 carbon atoms; each $R^4$ independently represents hydrogen or hydrocarbyl of 1 to 10 carbon atoms; $R^5$ represents a $C_{5-7}$ cycloalkanediyl —NH— or 1,4-piperazinediyl moiety optionally substituted by one or more hydrocarbyl groups of 1 to 10 carbon atoms; each $R^6$ independently represents $NR^8$ or $CHR^8$; $R^7$ represents hydrogen, hydrocarbyl of 1 to 30 carbon atoms or a —CO$(CHOH)_t(CR^3R^3)_i(NR^3)_k(CR^3R^3)_1OH$ group; $R^8$ represents a —$(CR^3R^3)_rNR^4R^7$ group; $R^9$ represents a $C_{5-7}$ cycloalkanediyl moiety optionally substituted by one or more hydrocarbyl groups of 1 to 10 carbon atoms; a is 1 to 10; b is 0 to 10; c is 1 to 10; d is 0 to 10; e is 1 to 10; f is 0 or 1; g is 1 to 10; h is 0 or 1; i is 0 to 10; j is 1 to 10; k is 0 or 1; 1 is 1 to 10; r is 1 to 10; s is 0 or 1, and t is 0 or 1; and integers b, d, f and i indicate numbers of associated moieties present, and the various moieties $[(CR^2R^2)_aO]$, $[(CR^3R^3)_cNR^4]$, $[(CHR^3)_eR^5]$ and $[(CR^3R^3)_g(R^6)_h]$ may be in any linear order.

Preferably in formula II X is O or $NR^4$, each $R^2$ independently represents hydrogen, $C_{1-4}$ alkyl or $C_{1-4}$ hydroxyalkyl, each $R^3$ independently represents hydrogen or $C_{1-4}$ alkyl, each $R^4$ represents hydrogen or methyl, $R^5$ represents a 1,4-piperazinediyl moiety or a cyclohexanediyl —NH— moiety optionally substituted by up to three methyl groups, each $R^6$ independently represents $NR^8$ or $CHR^8$, $R^7$ represents hydrogen, methyl or a —$CO(CHOH)_t(CHR^3)_i(NR^3)_k(CHR^3)_1OH$ group, $R^8$ represents a —$(CHR^3)_rNHR^7$ group, $R^9$ represents a cyclohexanediyl moiety optionally substituted by up to three methyl groups, a is 1 to 5, b is 0 to 5, c is 1 to 6, d is 0 to 5, e is 1 to 5, f is 0 or 1, g is 1 to 5, h is 0 or 1, i is 0 to 5, j is 1 to 5, k is 0 or 1, 1 is 1 to 5, r is 1 to 5, s is 0 or 1 and t is 0 or 1.

Advantageously, X is O or NH, each $R^2$ independently represents hydrogen, methyl or hydroxymethyl, each $R^3$ independently represents hydrogen or methyl, each $R^4$ represents hydrogen or methyl, $R^1$ represents a 1,4-piperazinediyl moiety or a cyclohexanediyl —NH— moiety optionally substituted by up to 3 methyl groups, each $R^6$ independently represents $NR^8$or $CHR^8$, $R^7$ represents hydrogen, methyl, or a $CO(CHOH)_t(CHR^3)_j(NR^3)_k(CHR^3)_1OH$ group, $R^8$ represents a $(CHR^3)_rNHR^7$ group, a is 2 or 3, b is 0 to 3, c is 2 to 6, d is 0 to 4, e is 3, f is 0 or 1, g is 2 or 3, h is 1, i is 0 or 1, j is 1 to 4, k is 0 or 1, 1 is 1 to 4, r is 1 or 2, s is 0 or 1 and t is 0 or 1.

Examples of preferred such moieties R when p=1 are the following:

—$NHCH_2CH_2N(CH_2CH_2NH_2)_2$; —$O(CH_2C(CH_2OH)_2O)_bH$ where b is 1 to 3, preferably 1; —$NH(CH_2CH_2NH)_dH$ where d is 1 to 4; —$NHCH_2CH_2NHCH_2CH_2OH$; —$NH(CH_2)_cNH_2$, where c is 2 to 6, preferably 2 to 4; —$NH(CH_2)_3NH(CH_2)_2NH(CH_2)_3NH_2$; —$NH(CH_2CH_2O)_2CH_2CH_2NH_2$; —$NH(CH_2CH_2O)_2H$; —$NH(CH_2)_3$(1,4-piperazinediyl)$(CH_2)_3NH_2$; —NH(1,4-cyclohexanediyl)$CH_2$(1,4-cyclohexanediyl)$NH_2$; —$NHCH_2$(1,3,3-trimethyl-5-aminocyclohexyl); —$NH(CH_2CH_2CH_2NH)_2H$; —$NH(CH_2)_3CH(CH_2NH_2)(CH_2)_4NH_2$; —$NHCH_2C(CH_3)_2CH_2NH_2$; —$NH(CH_2)_3N(CH_3)_2$; —$NHCH_2CH_2N(CH_2CH_2NHCO(CH_2)_2CH(CH_3)OH)_2$; —$NHCH_2CH_2N(CH_2CH_2NHCOCH_2N(CH_3)CH_2CH_2OH)_2$.

Examples of preferred such moieties R when p=2 are —$NH(CH_2CH_2NH)_3$— and —$NHCH_2CH_2N(CH_2CH_2NH_2)CH_2CH_2NH$—

Most preferably, R(H)p is selected from the group consisting of glycerol, pentaerythritol, dipentaerythritol, tripentaerythritol, ethylenediamine, diethylenetriamine, triethylenetetramine, tetraethylenepentamine, pentaethylenehexamine and tris(2-aminoethyl)amine.

The preparation of poly(hydroxycarboxylic acid) and its amide or ester derivatives is known and is described, for instance, in patent documents EP164817, WO95/17473, WO 96/07689, U.S. Pat. No. 5,536,445, GB2001083, GB1342746, GB1373660, U.S. Pat. No. 5,000,792, U.S. Pat. No. 4,349,389.

The poly(hydroxycarboxylic acid) moiety in formula I may be prepared by the interesterification of one or more hydroxycarboxylic acids together with a non-hydroxycarboxylic acid which acts as a chain terminator. The hydroxyl group in the hydroxycarboxylic acid and the carboxylic group in either carboxylic acid, may be primary, secondary or tertiary in character. Examples of suitable hydroxycarboxylic acids are 12-hydroxystearic acid, 12-hydroxy-9-oleic acid (ricinoleic acid), 6-hydroxycaproic acid, especially 12-hydroxystearic acid. Commercial 12-hydroxystearic acid normally contains up to 15% wt of stearic acid and other non-hydroxycarboxylic acids as impurities and can conveniently be used without further admixture to produce a polymer of molecular weight about 1000–2000. Where the non-hydroxycarboxylic acid is separately introduced, the proportion which is required in order to produce a polymer or oligomer of a given molecular weight can be determined either by simple experiment or by calculation.

The interesterification of the hydroxycarboxylic acid and the non-hydroxycarboxylic acid may be effected by heating the starting materials either or not in a suitable hydrocarbon solvent such as toluene or xylene and azeotroping off the formed water. The reaction may be carried out at temperature up to 250° C., conveniently at the reflux temperature of the solvent. Where the hydroxy group is secondary or tertiary, the temperature employed should not be so high as to lead to dehydration of the acid molecule. Catalysts for the esterification, such as p-toluenesulphonic acid, zinc acetate, zirconium naphthenate or tetrabutyl titanate, may be included, with the objective of either increasing the rate of reaction at a given temperature or of reducing the temperature required for a given rate of reaction.

The subsequent amidation with amines, aminoalcohols or esterification with polyols may be carried out according to methods known to those skilled in the art, by heating the poly(hydroxycarboxylic acid) with amines, aminoalcohols or polyols either or not in a suitable hydrocarbon solvent such as toluene or xylene and azeotroping off the formed water, with or without catalysts such as p-toluenesulphonic acid, zinc acetate, zirconium naphthenate or tetrabutyl titanate.

In fact, various patent documents disclose poly (hydroxycarboxylic acid) amide or ester derivatives, albeit for uses other than in fuels. For instance, GB1373660 discloses poly(hydroxycarboxylic acid) amide derivatives with amines such as 3-dimethylamino-propylamine and ethylenediamine for use as dispersing agent in dispersions of pigments in organic liquids. GB2001083 discloses poly (hydroxycarboxylic acid) amide derivatives with poly (ethyleneimine) (PEI) having a MW greater than 500 for a similar use. In U.S. Pat. No. 5,000,792 too poly (hydroxycarboxylic acid) amide derivatives with amines of the formula of $NH_2$—R'—N(R")—R'"—$NH_2$ are disclosed for use as pigment dispersing agent. WO95/17473 discloses poly(hydroxycarboxylic acid) amide derivatives with amines such as 3-dimethylaminopropylamine, ethylenediamine, poly(ethyleneimine) (PEI) having a MW greater than 500 and amines of the formula of $NH_2$—R'—N(R")—R'"—$NH_2$ for use in a method of preparing a non-aqueous dispersion of copper phthalocyanine. U.S. Pat. No. 4,349,389 discloses poly(hydroxycarboxylic acid) amide derivatives with amines such as 3-dimethylaminopropylamine, poly(ethyleneimine) (PEI) having a MW greater than 500 as dispersing agent in the preparation of a dispersible inorganic pigment composition. Finally, EP164817 disclose poly(hydroxycarboxylic acid) amide derivatives with polyamines(ethylenediamine, diethylenetriamine, etc.), aminoalcohols (diethanolamine, etc.) and ester derivatives with polyols (glycerol, etc.) for use as surfactant suitable for stabilising dispersions of solids in organic liquids and oil/water emulsions.

None of these patent documents, however, disclosed the use of poly(hydroxycarboxylic acid) amide or ester derivatives as fuel additive, acting as a detergent and as a lubricity additive in fuel compositions, which is therefore a further embodiment of the present invention.

The present invention further provides a fuel oil composition comprising a major amount of a fuel oil and a minor amount of a poly(hydroxycarboxylic acid)amide or ester derivative of formula I as defined above, and an additive concentrate suitable for addition to fuel oils which comprises a fuel-compatible diluent and a poly (hydroxycarboxylic acid)amide or ester derivative of formula I as defined above.

The poly(hydroxycarboxylic acid)amide or ester derivatives of formula I have useful application both in fuel compositions for spark-ignition engines (gasoline compositions) and in fuel compositions for compression ignition engines (diesel fuel compositions).

The "minor amount" referred to above is preferably less than 10% w of the composition, more preferably less than 1% w and advantageously less than 0.1% w (1000 ppmw) (parts per million by weight) of the composition. In preferred fuel compositions of the invention, the poly (hydroxycarboxylic acid)amide or ester derivative is present in an amount in the range 15 to 1000 ppmw of the fuel composition.

For gasoline compositions, the fuel will be a fuel boiling in the gasoline boiling range, and it may consist substantially of hydrocarbons or it may contain blending components. Alternatively, e.g. in countries such as Brazil, the fuel may consist substantially of ethanol.

Suitable liquid hydrocarbon fuels of the gasoline boiling range are mixtures of hydrocarbon boiling in the temperature range from about 25° C. to about 232° C., and comprise mixtures of saturated hydrocarbons, olefinic hydrocarbons and aromatic hydrocarbons. Preferred are gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, from thermally or catalytically reformed hydrocarbons, or from catalytically cracked or thermally cracked petroleum stocks, and mixtures of these. The hydrocarbon composition and octane level of the base fuel are not critical. The octane level, (R+M)/2, will generally be above about 85 (where R is Research Octane Number and M is Motor Octane Number).

Any conventional base gasoline can be employed in the practice of the present invention. For example, hydrocarbons in the gasoline can be replaced by up to a substantial amount of conventional alcohols or ethers, conventionally known for use in fuels. The base gasolines are desirably substantially free of water since water could impede a smooth combustion.

Normally, the gasolines to which the invention is applied may be leaded or unleaded, although are preferably substantially lead-free, and may contain minor amounts of one or more blending agents such as methanol, ethanol, tertiary butanol, ethyl tertiary butyl ether, methyl tertiary butyl ether, and the like, at from about 0.1% by volume to about 25% by volume of the base fuel, although larger amounts (e.g. up to 40% v) may be utilised. The gasolines can also contain conventional additives including antioxidants such as phenolics, e.g. 2,6-di-tert-butylphenol or phenylenediamines, e.g. N,N'-di-sec-butyl-p-phenylenediamine, dyes, metal deactivators, dehazers such as polyester-type ethoxylated alkylphenol-formaldehyde resins. Corrosion inhibitors, such as that commercially sold by Rhein Chemie, Mannheim, Germany as "RC 4801", or a polyhydric alcohol ester of a succinic acid derivative having on at least one of its alpha-carbon atoms an unsubstituted or substituted aliphatic hydrocarbon group having from 20 to 500 carbon atoms, for example, pentaerythritol diester of polyisobutylene-substituted succinic acid, the polyisobutylene group having an average molecular weight of about 950, in an amount from about 1 ppmw to about 1000 ppmw, may also be present. The fuels can also contain antiknock compounds such as methyl cyclopentadienylmanganese tricarbonyl, tetraethyl lead or other lead-containing compounds, and ortho-azodiphenol as well as co-antiknock compounds such as benzoyl acetone.

An effective amount of one or more poly (hydroxycarboxylic acid)amide or ester derivatives of formula I are introduced into the combustion zone of the engine in a variety of ways to prevent build-up of deposits, or to accomplish the reduction of intake valve deposits or the modification of existing deposits that are related to octane requirement. As mentioned, a preferred method is to add a minor amount of one or more poly(hydroxycarboxylic acid) amide or ester derivatives of formula I to the gasoline. For example, one or more poly(hydroxycarboxylic acid)amide or ester derivatives of formula I are added directly to the gasoline or are blended with one or more carriers and/or one or more hydrocarbon-soluble alkali metal or alkaline earth metal salts and/or one or more additional detergents before being added to the gasoline.

The amount of poly(hydroxycarboxylic acid)amide or ester derivative of formula I used will depend on the particular variation of formula I used, the engine, the fuel, and the presence or absence of carriers, additional detergents and diluents.

The carrier, when utilised, may conveniently have an average molecular weight from about 250 to about 5000. Suitable carriers, when utilised, include hydrocarbon based materials such as polyisobutylenes (PIB's), polypropylenes (PP's) and polyalphaolefins (PAO's), poly(internal olefins) PIO's, all of which may be hydrogenated or unhydrogenated but are preferably hydrogenated, and alkylbenzenes; polyether based materials including alkylene oxide polymers, interpolymers, copolymers and derivatives thereof wherein the terminal hydroxyl groups have been modified by esterification or etherification such as polybutylene oxides (poly-BO's), polypropylene oxides (poly-PO's), polyethylene oxides (poly-EO's), polyhexadecene oxides (poly-HO's) and mixtures thereof (i.e. both (poly-BO)+(poly-PO), poly-PO-EO, and poly-BO-PO)); and mineral oils such as those sold by member companies of the Royal Dutch/Shell group under the designations "HVI", "XHVI", "EDELEX", "CATENEX", "GRAVEX" (Trade Marks), Exxon Naphthenic 900 sus mineral oil and high viscosity index oils in general. The carrier is preferably selected from PIB's, poly-BO's and poly-PO's, poly-PO-EO's with poly-PO's and poly-PO-EO's being the most preferred.

A particularly prepared carrier fluid comprises a combination of a polyalphaolefin having a viscosity at 100° C. in the range $2\times10^{-6}$ to $2\times10^{-5}$ $m^2/s$ (2 to 20 centistokes) being a hydrogenated oligomer containing 18 to 80 carbon atoms derived from at least one alphaolefinic monomer containing from 8 to 16 carbon atoms, and a polyoxyalkylene compound selected from glycols, mono- and diethers thereof, having number average molecular weight ($M_n$) in the range 400 to 3000, the weight ratio polyalphaolefin: polyoxyalkylene compound being in the range 1:10 to 10:1.

The polyalphaolefins are primarily trimers, tetramers and pentamers, and synthesis of such materials is outlined in Campen et al., "Growing use of synlubes", Hydrocarbon Processing, February 1982, pages 75 to 82. The polyalphaolefin is preferably derived from an alphaolefinic monomer containing from 8 to 12 carbon atoms. Polyalphaolefins derived from decene-1 have been found to be very effective. The polyalphaolefin preferably has viscosity at 100° C. in the range of $6\times10^{-6}$ to $1\times10^{-5}$ $m^2/s$ (6 to 10 centistokes). Polyalphaolefin having a viscosity at 100° C. of $8\times10^{-6}$ $m^2/s$ (8 centistokes) has been found to be very effective.

Preferred polyoxyalkylene compounds for use in combination with these polyalphaolefins are described in EP-A-588429.

The carrier concentration in the final fuel composition is up to about 1000 ppm weight. When a carrier is present, the preferred concentration is from about 50 ppm by weight to about 400 ppm by weight, based on the total weight of the fuel composition. Once the carrier is blended with one or more compounds of formula I and any other desired components, the blend is added directly to the fuel or packaged for future use.

The hydrocarbon-soluble alkali metal or alkaline earth metal salt, when utilised, may be one of those described in WO 87/01126, and the compounds of formula I are particularly suitable for incorporation, as additional component, in fuel compositions as described in WO 87/01126. Preferred hydrocarbon-soluble alkali metal or alkaline earth metal salts are, however, alkali metal or alkaline earth metal salts of a succinic acid derivative. Such a salt of a succinic acid derivative, when utilised, will have as a substituent on one of its alpha-carbon atoms an unsubstituted or substituted aliphatic hydrocarbon group having from 20 to 200 carbon atoms. Alternatively, the succinic acid derivative will have as a substituent on one of its alpha-carbon atoms an unsubstituted or substituted hydrocarbon group having from 20 to 200 carbon atoms which is connected to the other alpha-carbon atom by means of a hydrocarbon moiety having from 1 to 6 carbon atoms, forming a ring structure. Suitable such salts are described for example in EP-A-207560 and in EP-A-491439.

The salts of the succinic acid derivative can be monobasic or dibasic. Monobasic salts in which the remaining carboxylic acid group has been transformed into an amide or ester group may also be used. Suitable alkali metal salts of a partial ester of an alkyl polyether alcohol with a succinic acid derivative are described in EP-A-491439.

Suitable metal salts include lithium, sodium, potassium, rubidium, caesium and calcium salts. Particularly preferred salts are described in EP-A-207560.

The aliphatic hydrocarbon substituent(s) of the succinic acid derivative is suitably derived from a polyolefin, the monomers of which have 2 to 6 carbon atoms. Thus, convenient substituents include polyethylene, polypropylene, polybutylenes, polypentenes, polyhexenes or mixed polymers. Particularly preferred is an aliphatic hydrocarbon group which is derived from polyisobutylene.

The hydrocarbon group may include an alkyl and/or an alkenyl moiety and may contain substituents. One or more hydrogen atoms may be replaced by another atom, for example halogen, or by a non-aliphatic organic group, e.g. an (un)substituted phenyl group, a hydroxy, ether, ketone, aldehyde or ester. A very suitable substituent in the hydrocarbon group is at least one other metal succinate group, yielding a hydrocarbon group having two or more succinate moieties.

The aliphatic hydrocarbon group should contain 20 to 200, preferably 35–150, carbon atoms. When a polyolefin is used as substituent the chain length is conveniently expressed as the number average molecular weight. The number average molecular weight of the substituent, e.g. determined by osmometry, is advantageously from 400 to 2000.

The succinic acid derivative may have more than one $C_{20-200}$ aliphatic hydrocarbon group attached to one or both alpha-carbon atoms, but preferably it has one $C_{20-200}$ aliphatic hydrocarbon group on one of its alpha-carbon atoms and on the other alpha-carbon atom either no substituent or a hydrocarbon of only a short chain length, e.g. $C_{1-6}$ group. The latter group can be linked with the $C_{20-200}$ hydrocarbon group forming a ring structure.

The gasoline compositions of the present invention may also contain one or more additional detergents. When additional detergents are utilised, the gasoline composition will comprise a mixture of a major amount of hydrocarbons in the gasoline boiling range as described hereinbefore, a minor amount of one or more compounds of formula I as described hereinbefore and a minor amount of an additional detergent selected from the group consisting of polyalkenyl amines, e.g. polybutyleneamines, such as "KEROCOM" polyisobutyleneamine, available ex BASF, Mannich amines, polyalkenyl succinimides, poly(oxyalkylene)amines, poly (oxyalkylene) carbamates, poly(alkenyl)-N-substituted carbamates, and mixtures thereof. As noted above, a carrier as described hereinbefore may also be included. The "minor amount" is preferably less than about 10% by weight of the total fuel composition, more preferably less than about 1% by weight of the total fuel composition and yet more preferably less than about 0.1% by weight of the total fuel composition.

The polyalkenyl amine detergents utilised comprise at least one monovalent hydrocarbon group having at least 50 carbon atoms and at least one monovalent hydrocarbon group having at most five carbon atoms bound directly to separate nitrogen atoms of a diamine. Preferred polyalkenyl amines are polyisobutenyl amines. Polyisobutenyl amines are known in the art and representative examples are disclosed in various us Patents including U.S. Pat. No. 3,753,670, U.S. Pat. No. 3,756,793, U.S. Pat. No. 3,574,576 and U.S. Pat. No. 3,438,757. Particularly preferred polyisobutenyl amines for use in the present fuel composition include N-polyisobutenyl-N', N'-dimethyl-1,3-diaminopropane (PIB-DAP), OGA-472 (a polyisobutenyl ethylene diamine available commercially from Oronite), N-polyisobutenyl diethylene triamine (PIB-DETA) and N-polyisobutenyl triethylene tetramine (PIB-TETA).

The Mannich amine detergents utilised comprise a condensation product of a high molecular weight alkyl-substituted hydroxyaromatic compound, an amine which contains an amino group having at least one active hydrogen atom (preferably a polyamine), and an aldehyde. Such Mannich amines are known in the art and are disclosed in U.S. Pat. No. 4,231,759. Preferably, the Mannich amine is an alkyl substituted Mannich amine.

The polyalkenyl succinimide detergents comprise the reaction product of a dibasic acid anhydride with either a polyoxyalkylene diamine, a hydrocarbyl polyamine or mixtures of both. Typically the succinimide is substituted with the polyalkenyl group but the polyalkenyl group may be found on the polyoxyalkylene diamine or the hydrocarbyl polyamine. Polyalkenyl succinimides are also known in the art and representative examples are disclosed in various patent references including U.S. Pat. No. 3,443,918, EP-A-208560, DE-OLS 3,126,404, U.S. Pat. No. 4,234,435, U.S. Pat. No. 4,810,261, U.S. Pat. No. 4,852,993, U.S. Pat. No. 4,968,321, U.S. Pat. No. 4,985,047, U.S. Pat. No. 5,061,291 and U.S. Pat. No. 5,147,414.

Particularly effective succinimide detergents are those obtained by reacting at least one amine, with a polyalkenyl derivative of a monoethylenically unsaturated $C_{4-10}$ dicarboxylic acid material in which the ratio of dicarboxylic acid moieties per polyalkenyl chain is not greater than 1.2:1 and the number average molecular weight ($M_n$) of the polyalkenyl chain is in the range from 1600 to 5000, e.g. as described in EP-A-587250.

Amines employed in the preparation of said succinimide detergents are preferably $C_{1-30}$, more preferably $C_{1-18}$, and especially $C_{8-12}$, amines containing 1 to 8 nitrogen atoms. Such amines may be branched or unbranched, saturated aliphatic, primary or secondary amines, containing 1 to 8 nitrogens, preferably mono- or diamines, such as ethylamine, butylamine, sec. butylamine, diethylamine and 3-dimethylamino-1-propylamine, but including higher polyamines such as alkylene polyamines, wherein pairs of nitrogen atoms are joined by alkylene groups of 2 to 4 carbon atoms.

Poly(oxyalkylene)amines are described, for example, in U.S. Pat. Nos. 4,985,047 and 4,332,595, in EP-A-440 248, EP-A-310 875, EP-A-208 978, WO 85/01956 and WO 97/41092.

The poly(oxyalkylene) carbamate detergents comprise an amine moiety and a poly(oxyalkylene) moiety linked together through a carbamate linkage, i.e., $$—O—C(O)—N— \quad (IX)$$

These poly(oxyalkylene) carbamates are known in the art and representative examples are disclosed for example in U.S. Pat. No. 4,191,537, U.S. Pat. No. 4,160,648, U.S. Pat. No. 4,236,020, U.S. Pat. No. 4,270,930, U.S. Pat. No. 4,288,612 and U.S. Pat. No. 4,881,945. Particularly preferred poly(oxyalkylene) carbamates for use in the present fuel composition include OGA-480 (a poly(oxyalkylene) carbamate which is available commercially from Oronite).

The poly(alkenyl)-N-substituted carbamate detergents utilised are of the formula:

$$R^o—A—C(=O)—OR'' \quad (X)$$

in which $R^o$ is a poly(alkenyl) chain; R"" is a hydrocarbyl or substituted hydrocarbyl group; and A is an N-substituted amino group. Poly(alkenyl)-N-substituted carbamates are known in the art and are disclosed in U.S. Pat. No. 4,936,868 and in WO 97/41092.

The one or more additional detergents are added directly to the fuel boiling in the gasoline boiling range, blended with one or more carriers, blended with one or more acid derivatives of formula I, or blended with one or more acid derivatives of formula I and one or more carriers before being added to the fuel.

The concentration of the one or more additional detergents in the final fuel composition is generally up to about 1000 ppmw for each additional detergent. When one or more additional detergents are utilised, the preferred concentration for each additional detergent is from about 10 ppmw to about 400 ppmw, based on the total weight of the fuel composition, even more preferably from about 25 ppmw to about 250 ppmw, based on the total weight of the fuel composition.

Additive components can be added separately to the gasoline or can be blended with one or more diluents, forming an additive concentrate, and added to the gasoline together. Suitable gasoline-compatible diluents are hydrocarbons and mixtures of hydrocarbons with alcohols or ethers, such as methanol, ethanol, propanol, 2-butoxyethanol, methyl tert-butyl ether, or higher alcohols such as "Dobanol 91", (Trade Mark) available from member companies of the Royal Dutch/Shell group.

Preferably the diluent is an aromatic hydrocarbon solvent such as toluene, xylene, mixtures thereof or mixtures of toluene or xylene with an alcohol. Additionally preferred diluents include "Shellsol AB", "Shellsol R", (Trade Marks) and low aromatic white spirit (LAWS), which are available from member companies of the Royal Dutch/Shell group.

For diesel fuel compositions, the fuel will be a diesel oil, which may be a hydrocarbon fuel (a middle distillate fuel oil), which may be a conventional fuel or a low-sulphur fuel having a sulphur concentration below 500 ppmw, preferably below 50 ppmw, advantageously below 10 ppmw. Diesel fuels typically have initial distillation temperature about 160° C. and 90% point of 290–360° C., depending on fuel grade and use. Vegetable oils may also be used as diesel fuels per se or in blends with hydrocarbon fuels.

Low-sulphur fuels will typically require a lubricity additive to reduce fuel pump wear.

Additive concentrates suitable for incorporating in diesel fuel compositions will contain the poly(hydroxycarboxylic acid)amide or -ester derivative of formula I and may contain a fuel-compatible diluent, which may be a non-polar solvent such as toluene, xylene, white spirits and those sold by member companies of the Royal Dutch/Shell Group under the Trade Mark "SHELLSOL", and/or a polar solvent such as esters and , in particular, alcohols, e.g. hexanol, 2-ethylhexanol, decanol, isotridecanol and alcohol mixtures such as those sold by member companies of the Royal Dutch/Shell Group under the Trade Mark "LINEVOL", especially "LINEVOL" 79 alcohol which is a mixture of $C_{7-9}$ primary alcohols, or the $C_{12-14}$ alcohol mixture commercially available from Sidobre Sinnova, France under the Trade Mark "SIPOL".

Additive concentrates and diesel fuel compositions prepared therefrom may additionally contain additional additives such as corrosion inhibitors, flow improvers, low molecular weight amine co-detergents, polyisobutylene succinimides as defined in WO 98/42808, dehazers, e.g. alkoxylated phenol formaldehyde polymers such as those commercially available as "NALCO" (Trade Mark)$_7$D07 (ex Nalco), and "TOLAD" (Trade Mark)$_{2683}$ (ex Petrolite; anti-foaming agents (e.g. the polyether-modified polysiloxanes commercially available as "TEGOPREN" (Trade Mark)$_{5851}$, Q 25907 (ex Dow Corning) or "RHODORSIL" (Trade Mark) (ex Rhone Poulenc)); ignition improvers (e.g. 2-ethylhexyl nitrate, cyclohexyl nitrate, di-tertiary-butyl peroxide and those disclosed in U.S. Pat. No. 4,208,190 at Column 2, line 27 to Column 3, line 21); anti-rust agents (e.g. that commercially sold by Rhein Chemie, Mannheim, Germany as "RC 4801", or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid), re-odourants, biocidal additives, anti-wear additives; anti-oxidants (e.g. phenolics such as 2,6-di-tert-butylphenol, or phenylenediamines such as N,N'-di-sec-butyl-p-phenylenediamine), metal deactivators and lubricity agents (e.g. those commercially available as EC831 (ex Paramins) or "HITEC" (Trade Mark) 580 (ex Ethyl Corporation), or those described in WO 98/01516 or WO 98/16596).

Preferred low molecular weight amine co-detergents are $C_{10-20}$ alkylamines. Aliphatic primary monoamines, particularly linear aliphatic primary monoamines, having 10 to 20 carbon atoms are particularly preferred. The alkylamine preferably has 10 to 18, e.g. 12 to 18, more preferably 12 to 16 carbon atoms. Dodecylamine is particularly preferred. Another particularly preferred group are the polyisobutylene succinimides disclosed in Wo 98/42808.

Unless otherwise stated, the (active matter) concentration of each additive in the diesel fuel is preferably up to 1 percent by weight more preferably in the range from 5 to 1000 ppmw (parts per million by weight of the diesel fuel).

The (active matter) concentration of the compound of formula I in the diesel fuel is preferably 50 to 1000 ppmw.

| Example | HSA {Sa} (mmol) | pTSA (mmol) | Xy (ml) | AV ($meqg^{-1}$) | $M_n$ | Amine[1] (eq.) | TBN[2] (%) | $M_n$ | p.d. |
|---|---|---|---|---|---|---|---|---|---|
| 1 | 1330 | 26 | 500 | 0.74 | 1350 | PEHA 0.9 | 2.04 | 1585 | 2.1 |
| 2 | as in 1 | | | 0.74 | 1350 | TETA 0.9 | 1.35 | 1738 | 2.2 |
| 3 | 335 | 7.9 | 170 | 1.01 | 988 | TEPA 0.9 | 2.54 | 1396 | 1.7 |
| 4 | 190 (13) | 5.6 | 300 | 1.5 | 700 | TETA 1.0 | 3.24 | 1200 | 2.0 |
| 5 | 670 | 13 | 500 | 0.71 | 1408 | TETA 2.0 | 1.86 | | |
| 6 | 670 | 13 | 500 | 0.67 | 1493 | TEPA 1.2 | 2.85 | | |
| 7 | 6670 | none | none | 0.66 | 1515 | TEPA 0.9 | 2.55 | | |
| 8 | 832 (176) | none | none | 1.02 | 976 | TEPA 0.9 | 3.66 | | |
| 9 | as in 6 | | | 0.69 | 1450 | PEHA 2.0 | 7.63 | | |
| 10 | as in 8 | | | 1.05 | 952 | PEHA 0.9 | 3.81 | | |
| 11 | 670 | 15.8 | 340 | 0.97 | 1036 | DMPA 0.9 | 0.88 | 1426 | 1.9 |
| 12 | 1664 (352) | none | none | 0.94 | 1064 | TEPA 0.5 | 1.69 | | |
| 13 | as in 12 | | | 0.94 | 1064 | PEHA 0.5 | 1.90 | | |
| 14 | 832 (624) | none | none | 1.71 | 585 | GLY 0.9 | | | |
| 15 | 1000[3] | 16.7 | 150 | 0.70 | 1428 | TEPA 1.0 | 1.34 | 1622 | 2.0 |
| 16 | as in 15 | | | 0.70 | i428 | PEHA 1.0 | 1.05 | 1581 | 1.9 |

[1]The following amines were used: TriEthyleneTetrAmine; TetraEthylenePentAmine; PentaEthyleneHexAmine and 3-DiMethylaminoPropylAmine. GLYcerol is an alcohol, not an amine. The product had a residual acid value of 0.091 meq/g.
[2]TBN is determined after treatment with water (Examples 1, 2, 3, 11) with calcium hydroxide (Example 4), with brine (Examples 5, 6), with sodium carbonate (Example 15), or with sodium carbonate (Example 16).
[3]Ricinoleic acid was used instead of hydroxystearic acid.

The (active matter) concentration of the dehazer in the diesel fuel is preferably in the range from 1 to 20, more preferably from 1 to 15, still more preferably from 1 to 10 and advantageously from 1 to 5 ppmw. The (active matter) concentrations of other additives (with the exception of the ignition improver and the lubricity agent) are each preferably in the range from 0 to 20, more preferably from 0 to 10 and advantageously from 0 to 5 ppmw. The (active matter) concentration of the ignition improver in the diesel fuel is preferably in the range from 0 to 600 and more preferably from 0 to 500 ppmw. If an ignition improver is incorporated into the diesel fuel, it is conveniently used in an amount of 100 to 500 ppmw. If a lubricity agent is incorporated into the diesel fuel, it is conveniently used in an amount of 100 to 500 ppmw.

The diesel oil itself may be an additised (additive-containing) oil or an unadditised (additive-free) oil. If the diesel oil is an additised oil, it will contain minor amounts of one or more additives, e.g. one or more additives selected from anti-static agents, pipeline drag reducers, flow improvers (e.g. ethylene/vinyl acetate copolymers or acrylate/maleic anhydride copolymers) and wax anti-settling agents (e.g. those commercially available under the Trade Marks "PARAFLOW" (e.g. "PARAFLOW" 450; ex Paramins), "OCTEL" (e.g. "OCTEL" W 5000; ex Octel) and "DODIFLOW" (e.g. "DODIFLOW" V 3958; ex Hoechst).

The present invention still further provides a method of operating an internal combustion engine (e.g. a spark-ignition engine or a compression-ignition engine) which comprises introducing into the combustion chambers of said engine a fuel composition (e.g. a gasoline composition or diesel fuel composition, as appropriate) as defined above.

Use of poly(hydroxycarboxylic acid)amide or -ester derivatives of formula I as additives in fuels for internal combustion engines may result in attaining one or more of a number of effects such as inlet system cleanliness (intake valves, fuel injectors, carburettors), combustion chamber cleanliness (in each case either or both of keep clean and clean-up effects), anti-corrosion (including anti-rust) and reduction or elimination of valve-stick.

The invention will be further understood from the following illustrative examples in which Examples 1 to 6 relate to the preparation of poly(hydroxycarboxylic acid)amide or -ester derivatives of formula I.

Various abbreviations are employed in the examples as follows:

"AV" denotes acid value, and this was determined using a "Metrohm 670"(trademark) potentiometric titrometer according to a method based upon ASTM D 664–89 with modified solvent system (the product is first dissolved in a toluene/methyl ethyl ketone 60/40 weight/weight mixture, and then diluted with a tert-butanol/water toluene 38.8/2.9/58.2 weight/weight/weight mixture);

"TBN" denotes total basic nitrogen, and this was determined using a "Metrohm 670"(Trade Mark) potentiometric titrometer according to a method based upon ASTM D 2896 with modified solvent system (75w w toluene, 12.5% w acetonitrile, 12.5% w acetic acid);

"$meqg^{-1}$" denotes milliequivalents per gram. In the examples and tests which follow, all parts and percentages are by weight unless stated otherwise, and temperatures are in degrees Celsius.

Commercial 12-hydroxystearic acid (referred to in the examples as 'HSa', ex Oleotec) used in the following examples contains 1% palmitic acid, 10% stearic acid (referred to in the examples as 'Sa'), 4% 12-ketostearic acid as impurities. Commercial ricinoleic acid (Nouracid CS80 ex Akzo Nobel) has an acid value of 175 mg KOH/g and hydroxyl value of 150 mg KOH/g.

EXAMPLE 1

400 g (1330 mmol) of HSa and 5 g (26 mmol) of p-toluene-sulphonic acid ('pTSA') were heated to reflux in 500 ml of xylene ('Xy')overnight and the water produced was removed via a Dean-Stark trap. After cooling, the solution was washed three times with 100 ml water, dried over magnesium sulphate whereupon the solvent was removed under vacuum. The product gave an AV of 0.74 $meqg^{-1}$ and a calculated molecular weight of 1400.

100 g (74.3 mmol) of poly(hydroxystearic acid) so produced and 15.5 (66.7 mmol, 0.9 eq) of pentaethylenehexamine ('PEHA') were heated to reflux in 150 ml Xy while removing water formed for a further three hours. After cooling, the solvent was removed under vacuum to give 115 g product with a TBN of 3.14%. GPC analysis using polystyrene as standard gave a $M_n$ of 1585 and a polydispersity of 2.1. 60 g of this product were dissolved in 500 ml of toluene and washed twice with 250 ml of water, dried over magnesium sulphate. The solvent was removed under vacuum to give 56 g of product with a TBN of 2.04%. This product was used in engine testing.

EXAMPLES 2–16

Derivatives were made in a similar manner as in Example 1. Minor variations include the presence or absence of pTSA, and the presence or absence of a solvent. In case no solvent is used, then the reaction temperature is set to 200° C. Reagents and properties of the products are set out in Table 1. The product of Example 13 is an ester, based on glycerol. The products of Examples 15 and 16 are amide derivatives of poly(ricinoleic acid).

COMPARATIVE EXAMPLE 1

Preparation of Oleylamine Amide Derivative of Oleic Acid According to Oronite's Patent EP-A-798,364

70g (223 mmol) of oleic acid(90% purity, Aldrich) and 74.6g (223 mmol) of oleylamine(80% purity, Aldrich) were heated with stirring at 120° C. for 3hrs and 150° C. for a few minutes under high vacuum. A quantitative yield of the product was obtained. IR($cm^{-1}$): 1633, 1539.

The products of Examples 1–4, 7–13, 15–16 and Comparative example 1 were subjected to at least one of the following tests in liquid fuels:

(i)Intake Valve Deposits using 1.2L Opel kadett Engine (ii)Injector fouling using 1.9L VW Passat (Indirect) Injection Diesel Engine (iii)XUD-9AL engine test (according to CEC PF-023-X-96

(iv)HFFR testing.

Part 1 Gasoline Engine Inlet System Cleanliness (i) Intake Valve Deposits using 1.2L Opel Kadett Engine)

Opel Kadett engine tests were carried out as described in the section of 'Intake valve and combustion chamber deposits using 1.2L Opel Kadett engine on page 57 of WO97/41092.

The test materials of a number of the Examples together with 250 ppmw of a carrier have been tested in a laboratory multicylinder engine to evaluate their intake valve deposit control performance. This engine was a 1.2L twin carburettor four cylinder spark-ignition engine manufactured by General Motors' Opel subsidiary and is used in the published inlet system cleanliness test CEC F-04-A-87. It has 79 mm bore, 61 mm stroke and is operated under a prescribed load and speed schedule representative of typical driving conditions as set forth in the following table:

| Step | Time, sec | Load, Nm | Speed, r/min |
|---|---|---|---|
| 1 | 30 | 0 | 1200 |
| 2 | 60 | 35 | 3000 |
| 3 | 60 | 29 | 1300 |
| 4 | 120 | 32 | 1850 |

In modifying the procedure, the air inlet was maintained at 25° C.(+ or −2 degrees) and no extra oil injection down the valve guides was used. The lubricating oil in the sump was "SHELL" "HELIX" 10 w/40 lubricating oil (API SG quality). The test duration was 40 hours including 2 hour shutdowns after the first and second 12 hour running periods. A twin carburettor set up was used to enable two additives to be tested simultaneously. Consequently, intake valve and combustion chamber deposit weights are average values from 2 cylinders.

Comparative A is base gasoline which has a RON 97of and a MON of 86.1, contains 36.7% v of aromatics with 8.9% olefins (IP156:92) and has a final boiling point of (ISO3405:88).

TABLE 2

| Opel Kadett results | | |
|---|---|---|
| Fuel example | [additive] in fuel (ppmw) | Intake valve deposit (mg/valve) |
| Comparative A | 0 | 220.5 |
| Example 1 | 250 | 3 |
| Example 2 | 250 | 5 |
| Example 3 | 250 | 13 |
| Example 11 | 250 | 68 |

It will be noted that gasoline compositions containing test materials of present invention gave much lower intake valve deposits than base gasoline.

Part 2 as Diesel Engine Injector Nozzle Cleanliness Detergents

Base fuels used in the following experiments had the following physical properties:

| Base fuel | B | C |
|---|---|---|
| Density (kg/l) at 15° C. (ASTM D 4052) | 0.8398 | 0.8431 |
| Sulphur (ppmw) (IP336) | 500 | 400 |
| Distillation, degree C (ASTM D 86) | | |
| IBP | 162 | 165 |
| 10% | 203 | 208 |
| 20% | 220 | 225 |
| 50% | 272 | 269 |
| 90% | 341 | 328 |
| 95% | 356 | 341 |
| FBP | 384 | 365 |
| Total Aromatics content (% w) | 26.1 | 35.7 |

In the following tests additive concentrates were used comprising a standard co-additive mixture (composed of an anti-rust agent, a dehazer, an antifoaming agent, a solvent, optionally a mineral oil, and an ignition improver) and the additive produced in the Examples 1–4, 7–10, 12, 13, 15 or 16.

Tests were performed by pouring the additive concentrate directly into the fuel.

(ii) Injector fouling using 1.9L VW Passat (Indirect) Injection Diesel Engine.

Passat engine tests were carried out as described on page 25 of WO98/42808. Steady-state injector nozzle fouling tests were performed according to the following method, employing a four cylinder VW Passat AAZ 1.9 TD (turbo diesel) IDI (indirect injection) diesel engine of 1896 cc displacement, equipped with a Bosch fuel injection system employing injector nozzles of type DNO SD 308. In this test method, the same injector nozzles were used for engine warm-up as for the steady-state deposit accumulation stage. New nozzles, cleaned with n-heptane, were used for each test.

The engine was warmed up at 1500 rpm engine speed and 25 Nm dynamometer load for 20 minutes. The engine speed was then raised to 2000 rpm and the dynamometer load was increased to 90 Nm over 15 seconds, and the engine was run at that speed and load for 3 hours.

A fouling index was generated from measurements of air flow through the injector nozzles, assessments being made on the new nozzles, before the test (Flow Clean), and afterwards on the fouled nozzles (Flow Fouled). Air flow was measured in a Ricardo air-flow rig according to ISO 4010, measurements being recorded at needle lifts of 0.1, 0.2 and 0.3 mm, with a vacuum pressure 600 mBar (60,000 Pa).

Build up of deposits in the nozzles causes a reduction in measured air flow, and degree of nozzle fouling (F) was calculated as follows:

$$F = \frac{\text{Flow Clean} - \text{Flow Fouled}}{\text{Flow Clean}} \times 100$$

A fouling number for one nozzle was calculated by averaging the three values of F obtained at the three different needle lifts. The fouling index (FI) was obtained by averaging the fouling numbers from all four nozzles. Test were performed on low-sulphur fuel formulations as described above, containing 499 ppmw of the poly(hydroxycarboxylic acid) amine or -ester derivatives.

Results of this test are given in Table 3 as follows:

| additive made in Example | [additive] in fuel (ppmw) | FI (%) |
|---|---|---|
| Comparative B * | 0 | 45 |
| 1 | 499 | 13 |
| 2 | 499 | 7 |
| 3 | 499 | 8 |
| 15 | 499 | 31 |
| 16 | 499 | 30 |

* 225 ppm of a lubricity additive as disclosed in WO 98/01516.

It will be noted that diesel compositions containing test materials of present invention, especially those from saturated hydroxycarboxylic acid (example 1, 2, 3) gave much lower injector fouling than base diesel as measured by Fouling Index (FI %).

(iii) XUD-9AL engine tests.

Results of this test are given in Table 4 as follows:

| Additive made in Example | [additive] in fuel (ppmw) | RF (%) |
|---|---|---|
| Comparative B * | 0 | 11 |
| Comparative C * | 0 | 10 |
| 2 | 250 | 34 |
| 4 | 250 | 21 |
| 7 | 130 | 28 |
| 8 | 130 | 38 |
| 9 | 130 | 16 |
| 10 | 130 | 35 |
| 12 | 130 | 39 |
| 13 | 130 | 39 |
| Comparative Example 1 | 130 | 18 |

* 225 ppm of a lubricity additive as disclosed in WO 98/01516.

It will be noted that diesel compositions containing test materials of present invention, examples 2, 4, 7, 8, 9, 10, 12 and 13 gave much improved injector cleanliness as measured in Residual Flow (RF %) than base diesel or the additive of comparative example 1.

(iv) HFRR results

HFRR testing was carried out as described in the section of 'further fuel testing examples' on page 14 of WO98/01516. The results are compiled in Table 1. Comparative D is Comparative H in Table 2 of WO98/01516.

| Additive made in Example | [additive] in fuel (ppmw) | Aver wear scar diameter (microns) |
|---|---|---|
| Comparative D | 0 | 622 |
| Example 4 | 150 | 362 |
| Example 14 | 130 | 307 |
| Comparative example 1 | 150 | 404 |

It will be noted that diesel compositions containing test materials of present invention, examples 4 and 14 gave surprisingly enhanced lubricity as measured in HFRR than base diesel.

What is claimed is:

1. A fuel oil composition consisting essentially of a major amount of a fuel oil selected from gasoline and diesel fuel and a minor amount of an additive in the form of a poly(hydroxycarboxylic acid) amide or ester derivative of the formula

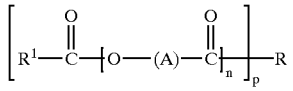

wherein R is the residue of an amine, an aminoalcohol or a polyol linked to the or each poly(hydroxycarboxylic acid) via an amide or ester linkage; $R^1$ is hydrogen or optionally substituted hydrocarbyl group containing up to 50 carbon atoms; A is an optionally substituted hydrocarbyl group; n is from 1–100, and p is from 2–5.

2. A fuel oil composition as claimed in claim 1, wherein the "minor amount" is less than 10% w of the composition.

3. A fuel oil composition as claimed in claim 1, wherein the poly(hydroxycarboxylic acid)amide or ester derivative is present in an amount in the range 15 to 1000 ppmw of the fuel composition.

4. A fuel oil composition as claimed in claim 1, wherein the fuel oil is diesel fuel and has an initial distillation temperature of about 160° C. and a 90% point of 290–360° C.

5. A fuel oil composition as claimed in claim 1, wherein the fuel oil is diesel oil and has an initial distillation temperature of about 160° C. and a 90% point of 290–360° C., and a sulphur concentration below 500 ppmw.

* * * * *